US005927612A

United States Patent [19]

Cooke

[11] Patent Number: 5,927,612

[45] Date of Patent: Jul. 27, 1999

[54] INJECTOR

[75] Inventor: Michael Peter Cooke, Gillingham, United Kingdom

[73] Assignee: Lucas Industries plc, United Kingdom

[21] Appl. No.: 08/902,637

[22] Filed: Jul. 30, 1997

[30] Foreign Application Priority Data

Aug. 10, 1996 [GB] United Kingdom ..... 961685103

[51] Int. Cl.[6] ..... F02M 61/00

[52] U.S. Cl. ..... 239/533.12

[58] Field of Search ..... 239/533.2, 533.3, 239/533.4, 533.9, 533.12

[56] References Cited

U.S. PATENT DOCUMENTS

| | | | |
|---|---|---|---|
| 4,238,075 | 12/1980 | Bander | 239/533.4 |
| 4,528,951 | 7/1985 | Yamada | 239/533.4 |

FOREIGN PATENT DOCUMENTS

| | | | |
|---|---|---|---|
| 886596 | 10/1942 | France . | |
| 977818 | 11/1942 | France . | |
| 1005022 | 11/1949 | France . | |
| 2 408 043 | 11/1978 | France . | |
| 703194 | 3/1937 | Germany | 239/533.12 |
| 862 976 | 1/1953 | Germany . | |
| 28 03 774 | 1/1978 | Germany . | |
| 58-119964 | 7/1983 | Japan | 239/533.12 |
| 58-165566 | 9/1983 | Japan | 239/533.12 |
| 119567 | 10/1917 | United Kingdom . | |
| 1569100 | 6/1980 | United Kingdom . | |
| 2128252 | 4/1984 | United Kingdom | 239/533.12 |
| 2 185 070 | 7/1987 | United Kingdom . | |

*Primary Examiner*—Andres Kashnikow
*Assistant Examiner*—Jorge S. Bocanegra
*Attorney, Agent, or Firm*—Andrus, Sceales, Starke & Sawall

[57] ABSTRACT

An injector is disclosed which comprises a valve needle moveable within a bore of a nozzle body. The valve needle is engageable with a seating, and downstream of the seating, the nozzle body and valve needle together define a chamber. Passages communicate with the chamber to supply fuel from the chamber to outlet ports. The ports are located so as to be covered by the valve needle when the needle engages its seating, movement of the needle away from its seating beyond a predetermined distance uncovering the ports.

5 Claims, 1 Drawing Sheet

INJECTOR

BACKGROUND OF THE INVENTION

This invention relates to an injector for use in supplying fuel to a cylinder of an associated engine.

In order to improve the efficiency of an engine and minimise the level of emissions from the engine, in use, it is desirable to supply an initial, relatively small quantity of fuel to a cylinder of the engine conveniently through a relatively low cross section injection area followed by a main injection through a larger injection area. It is an object of the invention to provide an injector of relatively simple construction which can be operated so as to obtain a low initial injection rate followed by a higher rate.

SUMMARY OF THE INVENTION

According to the present invention there is provided an injector comprising a nozzle body provided with a through bore shaped so as to define a seating, a valve needle engageable with the seating, the needle and nozzle body defining a chamber downstream of the seating, wherein the nozzle body includes at least one outlet passage arranged to permit communication between the chamber and a respective outlet port, the or each outlet port being closed by the valve needle when the needle engage its seating, retraction of the needle away from its seating beyond a predetermined distance uncovering the or at least one of the outlet ports.

The nozzle body conveniently includes a plurality of outlet ports, the ports preferably being oriented to spray the fuel evenly into the cylinder of an associated engine.

The outlet ports may be spaced apart from one another in the direction of the axis of the nozzle body, whereby the number of outlet ports opened during injection is dependent upon the magnitude of lift of the valve needle.

The needle preferably includes an outlet passage in constant communication with the chamber, the outlet passage communicating with an outlet port provided at an end of the needle.

BRIEF DESCRIPTION OF THE DRAWINGS

The invention will further be described, by way of example, with reference to the accompanying dr a wings, in which.

DETAILED DESCRIPTION OF THE PREFERRED EMBODIMENTS

Figure 1:
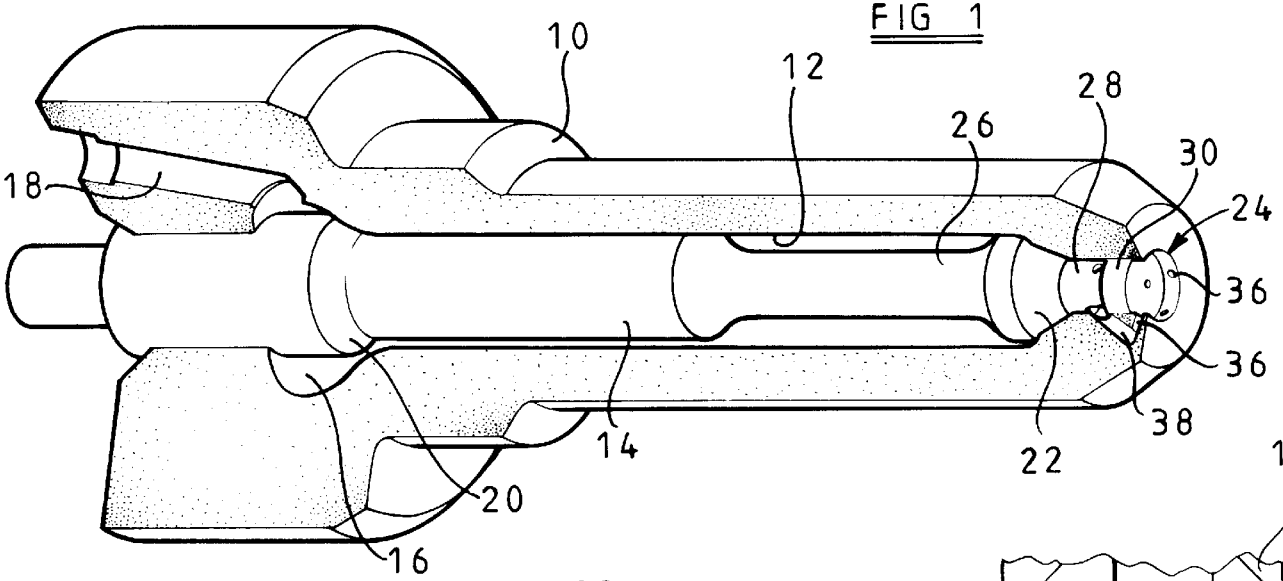
FIG. 1 is a perspective view, part broken away, of part of an injector in accordance with an embodiment of the invention.

FIG. 1 illustrates part of an injector for use in supplying fuel to a cylinder of an associated engine. The injector comprises a nozzle body 10 having a through bore 12 formed therein, a valve needle 14 being slidable within the bore 12. The bore 12 defines an annular chamber 16 which communicates through a passage 18 with a source of fuel at high pressure. The part of the valve needle 14 located within the annular chamber 16 includes an angled thrust surface 20 against which the high pressure fuel supplied to the chamber 16 acts to lift the valve needle 14 against the action of a spring (not shown). The spring is arranged to bias the valve needle 14 such that an angled region 22 thereof engages a seating formed in the nozzle body 10 such that when the needle 14 engages its seating, substantially no fuel is delivered from the injector, retraction of the valve needle into the body and away from the seating permitting fuel to flow through the injector and out of an opening 24 provided in the end of the nozzle body 10.

In order to ensure that the angled region 22 of the valve needle 14 properly engages its seating, the valve needle 14 includes a region 26 of reduced diameter which permits the valve needle 14 to flex slightly thus permitting the valve needle 14 to tolerate slight inaccuracies in the machining of the nozzle body 10, in particular the concentricity of the seating with the remainder of the bore 12.

Figure 2:
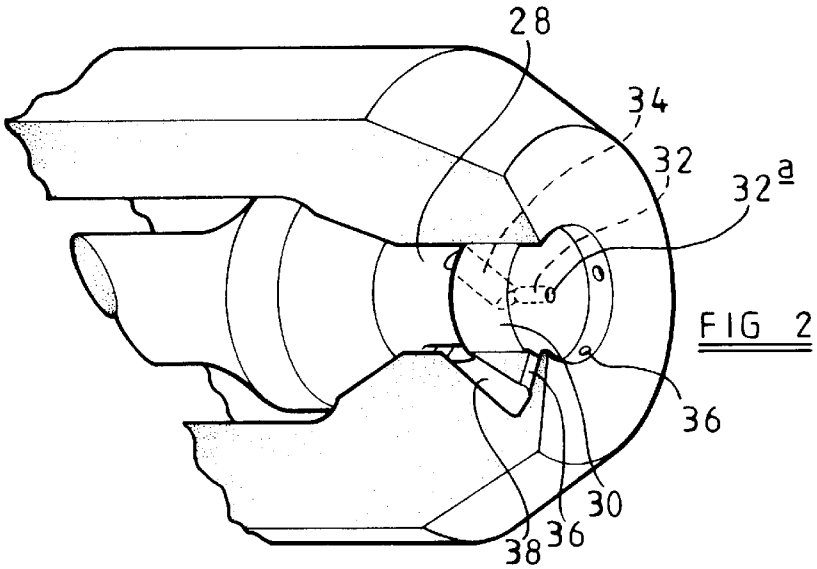
FIG. 2 is an enlarged view of part of FIG. 1.

As illustrated in FIG. 2, downstream of the seating the valve needle 14 defines with the nozzle body 10 an annular chamber 28, and it will be appreciated that the flow of fuel to the annular chamber 28 is controlled by the position of the valve needle 14, fuel only being supplied to the annular chamber 28 when the valve needle 14 is lifted from its seating. Downstream of the annular chamber 28, the valve needle 14 includes a region 30 of cylindrical form the diameter of which is substantially equal to the inner diameter of the part of the bore 12 receiving the region 30 such that the valve needle 14 forms a substantially fluid tight seal with that part of the nozzle body 10. An axially extending passage 32 is provided in the region 30 of the valve needle 14, an angled passage 34 communicating with the axially extending passage 32 to permit continuous communication between a port 32*a* at the end of the axially extending passage 32 and the chamber 28.

The valve body 10 is provided with five outlet ports 36 which are located adjacent the opening 24 of the nozzle body 10 and are arranged such that when the valve needle 14 engages its seating, the cylindrical region 30 of the valve needle 14 closes the outlet ports 36. Each of the outlet ports 36 communicates with a passage 38 which in turn communicates with the chamber 28 such that throughout the range of movement of the valve needle 14, communication is permitted between the chamber 28 and the outlet ports 36. As denoted by the dashed lines in FIG. 2, the outlet ports 36 are arranged such that fuel flowing therefrom, in use, does not impinge upon the fuel flowing from an opposing port, thus the fuel injected by the injector in use does not collide at a single point in front of the nozzle. It is envisaged that the orientation of the outlet ports 36 may be selected so as to provide a suitable degree of interference between the sprays of fuel from the outlet ports 36, thus permitting a suitable selection of the distribution of fuel spray in the cylinder of the engine permitting better atomization of the fuel and a more even distribution of the fuel within the cylinder than is achieved using a conventional arrangement.

In use, in the position illustrated in FIGS. 1 and 2, the valve needle 14 is lifted from its seating thus fuel supplied at high pressure to the passage 18 is able to flow past the seating to the annular chamber 28. As the annular chamber 28 is in constant communication with the axially extending passage 32 provided in the needle 14, a spray of fuel is delivered to the cylinder through the axially extending passage 32. In addition, as the cylindrical region 30 of the needle 14 is moved by a sufficient amount to uncover the outlet ports 36, and as the outlet ports 36 are in constant communication with the annular chamber 28, fuel is also delivered to the cylinder through each of the outlet ports 36.

In order to terminate injection, the valve needle 14 is moved into engagement with its seating using any suitable conventional technique, thus the supply of fuel at high pressure to the annular chamber 28 is terminated. The movement of the valve needle 14 results in the cylindrical region 30 thereof closing the outlet ports 36 thus fuel delivery through the outlet ports 36 is terminated. In addition, as high pressure fuel is no longer supplied to the annular chamber 28, the flow of fuel through the axially extending passage 32 terminates.

In order to commence the next injection, the valve needle 14 is lifted using any suitable technique. The initial movement of the valve needle 14 results in the application of high pressure fuel to the annular chamber 28 past the seating. As the axially extending passage 32 in the needle 14 is in constant communication with the chamber 28, injection of fuel commences through the axially extending passage 32. It will be appreciated that the dimensions of the axially extending passage 32 are relatively small compared to the area available for flow of fuel to the chamber 28, thus the flow rate of fuel during this initial part of injection is relatively low, the area through which injection occurs being restricted to the area of the outlet port 32*a*. At this stage, the movement of the valve needle 14 is insufficient to uncover the outlet ports 36, the cylindrical part 30 of the valve needle 14 covering the outlet ports 36 thus preventing injection of fuel therethrough.

Subsequently, the valve needle 14 is lifted to a sufficient extent for the cylindrical region 30 to uncover the outlet ports 36. Since the outlet ports 36 are in constant communication with the annular chamber 28 throughout the range of movement of the valve needle 14, fuel is delivered through the outlet ports 36 in addition to delivery of fuel through the axially extending passage 32, thus increasing the area available for fuel injection. It will be appreciated that the additional delivery of fuel through the outlet ports 36 results in an increased rate of fuel delivery through the injector.

Figure 3:
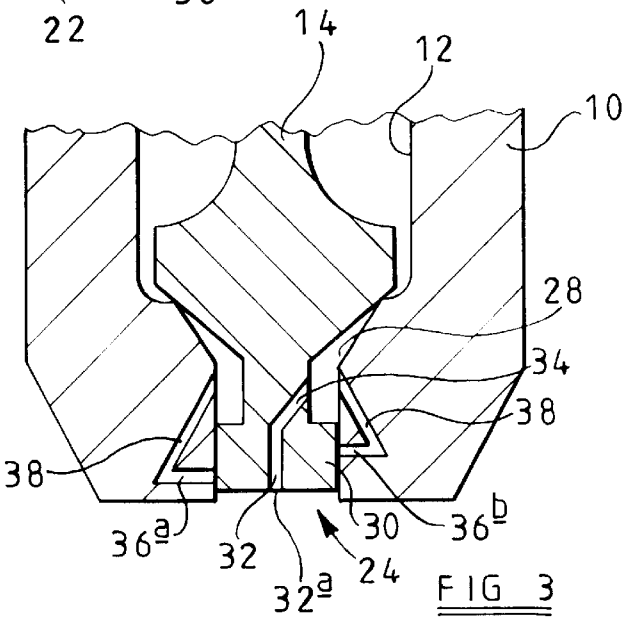
FIG. 3 is a diagrammatic cross-sectional view of an alternative embodiment.

FIG. 3 illustrates an arrangement similar to that of FIGS. 1 and 2 but in which the outlet ports 36 are arranged so as to be axially spaced from one another as well as being spaced around the bore 12 in the manner described hereinbefore. In use, upon lifting the valve needle 14 from its seating, the chamber 28 is supplied with fuel at high pressure, and injection commences through the axially extending passage 32. Subsequent movement of the valve needle 14 results in the cylindrical region 30 thereof uncovering a first ring of outlet ports 36*a* thus increasing the area through which fuel is injected. Further movement of the valve needle 14 away from its seating results in a second ring of outlet ports 36*b* being uncovered permitting fuel to be delivered through a greater area. It will be appreciated that although FIG. 3 only illustrates the provision of two rings of outlet ports 36, further rings may be provided if desired. Further, the outlet ports need not be arranged in rings.

Although the embodiments described hereinbefore include an axially extending passage provided in the valve needle in constant communication with the annular chamber 28, it will be appreciated that such a passage may be omitted, the different area for fuel injection being achieved solely by providing outlet ports at a range of axial locations within the nozzle body 10.

I claim:

1. An injector for use in supplying fuel to a cylinder of an associated engine, the injector comprising a nozzle body having an axis, a through bore extending along the axis and shaped so as to define a seating, a valve needle engageable with the seating, the seating, the needle and nozzle body defining a chamber downstream of the seating, wherein the nozzle body includes at least one outlet passage in constant communication with the chamber and arranged to permit communication between the chamber and a respective outlet port, the or each outlet port being closed by the valve needle when the needle engages its seating, retraction of the needle away from its seating beyond a predetermined distance uncovering the or at least one of the outlet ports, and a further outlet passage provided in the valve needle in constant communication with the chamber, and communicating with an outlet port provided at an end of the needle.

2. An injector as claimed in claim 1, wherein the nozzle body includes a plurality of outlet ports.

3. An injector as claimed in claim 2, wherein the outlet ports are arranged so that, when uncovered, fuel is sprayed uniformly into the cylinder of the associated engine.

4. An injector as claimed in claim 2, wherein the outlet ports are spaced apart from one another in the direction of the axis of the nozzle body.

5. An injector as claimed in claim 1, wherein the valve needle is moveable away from its seating upon the application of high pressure fuel thrust surfaces thereof.

* * * * *